US009030185B2

(12) United States Patent
Nishibori et al.

(10) Patent No.: US 9,030,185 B2
(45) Date of Patent: May 12, 2015

(54) POWER FACTOR CORRECTION CIRCUIT

(71) Applicant: Minebea Co., Ltd., Nagano (JP)

(72) Inventors: Kohei Nishibori, Iwata (JP); Nadthawut Chalermboon, Fukuroi (JP)

(73) Assignee: Minebea Co., Ltd., Kitasaku-Gun (JP)

( * ) Notice: Subject to any disclaimer, the term of this patent is extended or adjusted under 35 U.S.C. 154(b) by 187 days.

(21) Appl. No.: 13/740,507

(22) Filed: Jan. 14, 2013

(65) Prior Publication Data

US 2013/0207621 A1 Aug. 15, 2013

(30) Foreign Application Priority Data

Feb. 9, 2012 (JP) ..... 2012-026505

(51) Int. Cl.
*G05F 1/56* (2006.01)
*G05F 1/70* (2006.01)

(52) U.S. Cl.
CPC ..... *G05F 1/70* (2013.01)

(58) Field of Classification Search
CPC .. Y02B 20/346; H02M 1/4225; H02M 7/217; H02M 2001/009
USPC ..... 363/17, 37, 39, 45, 47, 89, 97, 124, 363/127; 323/222, 224, 225, 259, 299, 323/282–288
See application file for complete search history.

(56) References Cited

U.S. PATENT DOCUMENTS

| | | | | |
|---|---|---|---|---|
| 6,570,366 | B1 * | 5/2003 | Lin et al. | 323/207 |
| 7,215,560 | B2 * | 5/2007 | Soldano et al. | 363/44 |
| 7,279,868 | B2 * | 10/2007 | Lanni | 323/222 |
| 8,125,203 | B2 * | 2/2012 | Ayukawa et al. | 323/272 |
| 8,384,368 | B2 * | 2/2013 | Osaka | 323/285 |
| 8,773,111 | B2 * | 7/2014 | Nishikawa | 324/76.11 |

FOREIGN PATENT DOCUMENTS

JP A-2011-152017 8/2011

* cited by examiner

*Primary Examiner* — Rajnikant Patel
(74) *Attorney, Agent, or Firm* — Oliff PLC

(57) ABSTRACT

A power factor correction circuit includes a first series circuit, a second series circuit, a smoothing capacitor, and a reactor. The power factor correction circuit further includes an input voltage detector that detects an input voltage of at least one end of an AC power source based on one end on a ground side of the smoothing capacitor, and a current detector that detects a reactor current from the AC power source, the current detector having a transformer in which the reactor is a primary side, and first and second switching elements are controlled based at least partially on a reactor current detection signal that is output in accordance with the reactor current from a secondary side of the transformer to supply a desired DC voltage to a load circuit.

6 Claims, 11 Drawing Sheets

POWER FACTOR CORRECTION CIRCUIT

BACKGROUND OF THE INVENTION

1. Field of the Invention

The present invention relates to a power factor correction circuit, and particularly to a critical mode operation of a bridgeless power factor correction circuit.

2. Description of the Related Art

Conventionally, in order to supply electric power to a load, a power source apparatus in which an AC (alternating current) voltage from an input AC power source is rectified and then converted to a desired AC or DC (direct current) voltage and supplied to the load has been widely used. In this kind of power source apparatus, a power factor correction circuit needs to be provided in order to correct the power factor and reduce the EMI noise generated by the power source apparatus. Therefore, in a general constitution of a power supply apparatus, a rectification circuit consisting of a diode bridge and a power factor correction circuit consisting of a boost converter circuit are installed in the input stage.

In recent years, in a power source apparatus, a so-called bridgeless power factor correction circuit, in which a front stage diode bridge is made unnecessary by combining a power factor correction function by a boost operation and a rectification function, has been proposed (for example, refer to Japanese Patent Application Laid-Open (JP-A) No. 2011-152017). In this power factor correction circuit, the input stage of the power supply apparatus can be constituted by a simple circuit and the conduction loss of the diode can be reduced, and thus this kind of power factor correction circuit is advantageous over a constitution in which the rectification circuit and the power factor correction circuit are provided separately.

SUMMARY OF THE INVENTION

In general, a critical mode is used as an operation mode of a power factor correction circuit. In a critical mode, a time point at which a reactor current becomes zero is detected during the period in which a main switching element is turned OFF, and the ON/OFF of the main switching element is controlled such that the main switching element is switched ON immediately after the above-mentioned time point is detected. Therefore, in order to operate the power factor correction circuit in a critical mode, it is necessary to detect the time point at which the reactor current becomes zero. As such a current detection technology, a current transformer or a current detection resistor has generally been used, as in the power factor correction circuit disclosed in JP-A No. 2011-152017.

However, for example, in a current detection technology using a current transformer, there has been a problem in that an additional circuit such as a reset circuit is necessary in order to achieve the necessary detection accuracy, and thus the circuit constitution and the control thereof becomes complicated. In the case that a current detection resistor is connected to the reactor current path, heat generation and power loss in the resistor may become an impediment to miniaturization and efficiency improvement of the power factor correction circuit, and by extension the power supply apparatus itself.

The present invention has been made in view of the above-described problems, and an object of the present invention is to provide a power factor correction circuit in which the time point at which the reactor current becomes zero can be detected with an inexpensive and simple circuit constitution.

The below-described embodiments exemplify constitutions of the present invention, and will be explained in an itemized manner in order to facilitate the understanding of the various constitutions of the present invention. Each item is not meant to limit the technical scope of the present invention, and substitutions or deletions of a portion of the constituent elements of each item as well as additions of other constituent elements upon referring to the detailed description of the preferred embodiments are included within the technical scope of the invention.

According to a first aspect of the present invention, there is provided a power factor correction circuit comprising: a first series circuit that consists of a first rectifier element (D1) and a first switching element (Q1), a second series circuit that consists of a second rectifier element (D2) and a second switching element (Q2) and is connected in parallel to the first series circuit, a smoothing capacitor (C2) that is connected in parallel to the first and second series circuits and a load circuit, and a reactor (L1), one end of which is connected to a connecting point between the first rectifier element (D1) and the first switching element (Q1) or a connecting point between the second rectifier element (D2) and the second switching element (Q2), and the other end of which is connected to one end of an AC power source (Vac), wherein the power factor correction circuit further comprises an input voltage detector that detects an input voltage of at least one end of the AC power source (Vac) based on one end on a ground side of the smoothing capacitor (C2), and a current detector that detects a reactor current from the AC power source (Vac), the current detector having a transformer (Tr) in which the reactor (L1) is a primary side, and the first and second switching elements (Q1, Q2) are controlled based at least partially on a reactor current detection signal that is output in accordance with the reactor current from a secondary side of the transformer (Tr) to supply a desired DC voltage to the load circuit.

In the first aspect, the reactor current detection signal is generated based on one or more induced voltages generated on a secondary side of the transformer (Tr), and a polarity of the induced voltage(s) generated during a positive half cycle of the AC power source (Vac) and a polarity of the induced voltage(s) generated during a negative half cycle of the AC power source (Vac) are in a reversed polarity.

In the first aspect, the positive half cycle and the negative half cycle of the AC power source (Vac) are determined based on an input voltage detection signal output from the input voltage detector.

In the first aspect, the induced voltage(s) generated on a secondary side of the transformer (Tr) includes a first and a second induced voltage, the reactor current detection signal includes a first and a second reactor current detection signal generated respectively based on the first and second induced voltages, a polarity of the first induced voltage generated during the positive half cycle of the AC power source (Vac) and a polarity of the second induced voltage generated during the negative half cycle of the AC power source (Vac) are correspondent to each other, and a polarity of the first induced voltage generated during the negative half cycle of the AC power source (Vac) and a polarity of the second induced voltage generated during the positive half cycle of the AC power source (Vac) are correspondent to each other.

In the first aspect, there is further provided a switching unit in which the first reactor current detection signal, the second reactor current detection signal, and the input voltage detection signal are input, and a signal generated based on either one of the first reactor current detection signal or the second reactor current detection signal is output according to the positive half cycle and the negative half cycle of the AC power source (Vac).

In the first aspect, there is also provided a capacitor (C1), one end of which is connected to a connecting point between the AC power source (Vac) and the reactor (L1) and the other end of which is connected to one end on a ground side of the smoothing capacitor (C2).

The power factor correction circuit according to the present invention is constituted as described above, and thus in the bridgeless power factor correction circuit, it is possible to detect the time point at which the reactor current becomes zero with an inexpensive and simple circuit constitution.

DETAILED DESCRIPTION OF THE PREFERRED EMBODIMENTS

Hereinafter, embodiments of the present invention will be explained with reference to the attached drawings.

Figure 1:
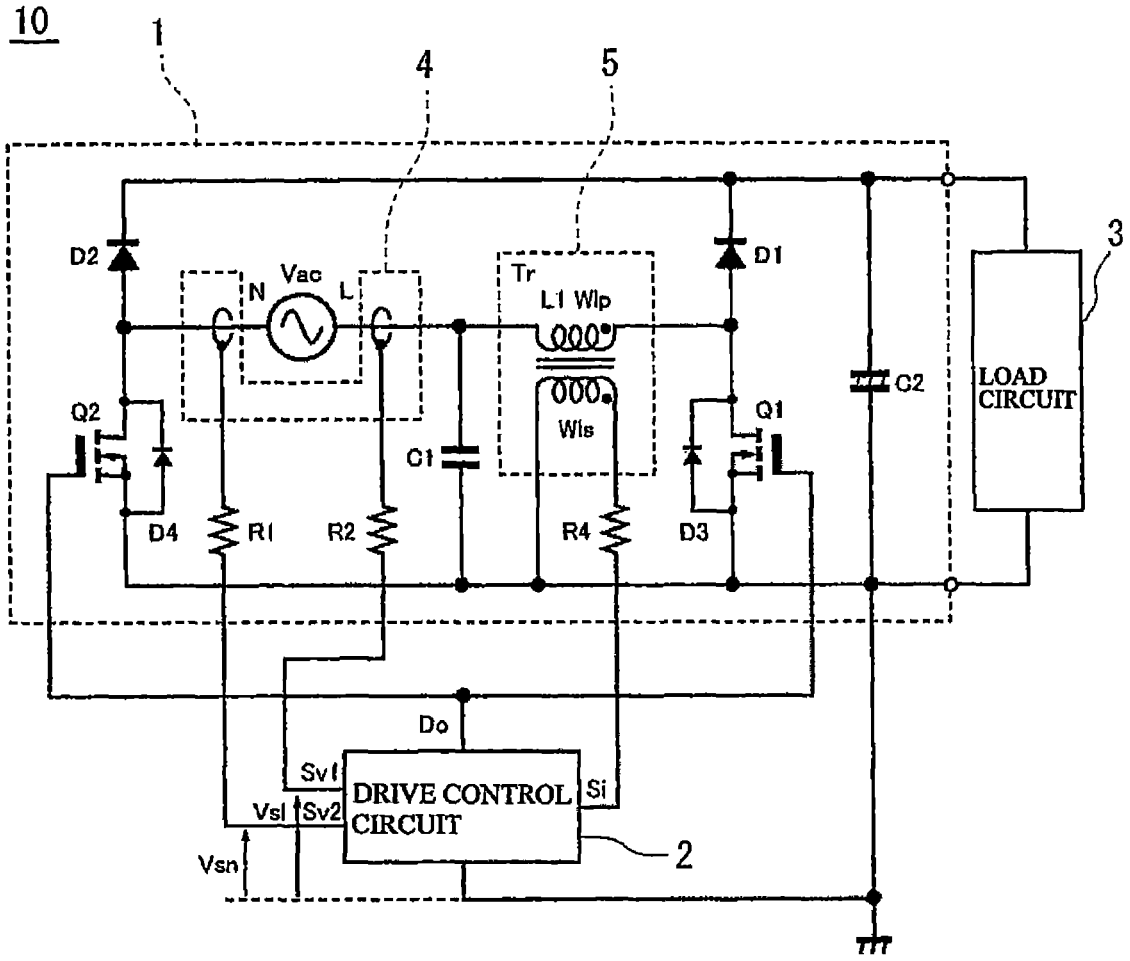
FIG. 1 is a circuit constitution diagram illustrating a power supply apparatus including a power factor correction circuit according to a first embodiment of the present invention.

FIG. 1 is a circuit constitution diagram illustrating a power supply apparatus 10 including a power factor correction circuit 1 according to a first embodiment of the present invention. In the power supply apparatus 10, the power factor correction circuit 1 functions to rectify, boost, and correct the power factor of an AC voltage of an AC power source Vac, and then apply it to a load circuit 3. The load circuit 3 is typically constituted by a DC-DC converter circuit or a DC-AC converter circuit, and the power factor correction circuit 1 constitutes an input stage of the power supply apparatus 10 that on the whole forms an AC-DC converter or an AC-AC converter. However, the present invention is not limited by the specific constitution of the load circuit 3, and any appropriate circuit can be used.

The power factor correction circuit 1 includes a first series circuit (indicated by reference numeral D1-Q1 when necessary) consisting of a first rectifier element D1 and a first switching element Q1, and a second series circuit (indicated by reference numeral D2-Q2 when necessary) consisting of a second rectifier element D2 and a second switching element Q2. In the power factor correction circuit 1, diodes are used as the first and second rectifier elements D1 and D2, and MOS-FETs are used as the first and second switching elements Q1 and Q2. In the first series circuit, the anode terminal of the first rectifier element D1 is connected to the drain terminal of the first switching element Q1, and in the second series circuit, the anode terminal of the second rectifier element D2 is connected to the drain terminal of the second switching element Q2.

In the first series circuit and the second series circuit, the cathode terminals of the first and second rectifier elements D1 and D2 are connected to each other, and the source terminals of the first and second switching elements Q1 and Q2 are connected to each other, and these connections are in parallel. Further, one end of a smoothing capacitor C2 is connected to the connecting point of the cathode terminals of the first and second rectifier elements D1 and D2, and the other end of the smoothing capacitor C2 is connected to the connecting point of the source terminals of the first and second switching elements Q1 and Q2. In this way, the smoothing capacitor C2 is connected in parallel to the first series circuit and the second series circuit. The load circuit 3 of the power factor correction circuit 1 is connected in parallel to the smoothing capacitor C2.

The third and fourth rectifier elements D3 and D4 are respectively connected in parallel to the first and second switching elements Q1 and Q2. The rectifier elements D3 and D4 can be constituted by using an external diode, or they can also be constituted by using a parasitic diode built into a MOS-FET.

The power factor correction circuit 1 includes a reactor L1. One end of the reactor L1 is connected to the connecting point of the first rectifier element D1 and the first switching element Q1, and the other end of the reactor L1 is connected to one end L (hereinafter also referred to as "L-side terminal") of the AC power source Vac. In the power factor correction circuit 1, the other end N (hereinafter also referred to as "N-side terminal") of the AC power source Vac is connected to the connecting point of the second rectifier element D2 and the second switching element Q2.

Hereinbelow, the connecting line of the source terminals of the first and second switching elements Q1 and Q2 and the one end of the smoothing capacitor C1 will also be referred to as the common line. During operation of the power factor correction circuit 1, one end on the common line side of the smoothing capacitor C1 forms an output terminal on the ground side with regard to an output voltage of the smoothing capacitor C1. In other words, the common line constitutes a ground of the output voltage of the power factor correction circuit 1.

The power factor correction circuit 1 includes a capacitor C1, one end of which is connected to the connecting point of the AC power source Vac and the reactor L1, and the other end of which is connected to the common line.

Further, the power factor correction circuit 1 includes a drive control circuit 2 that controls the ON/OFF operation of the first and second switching elements Q1 and Q2. The ON/OFF operation of the first and second switching elements Q1 and Q2 is executed as will be explained below in accordance with a drive signal (in this case, a gate drive signal) that is output from a drive signal output terminal Do of the drive control circuit 2. Thereby, the power factor correction circuit 1 functions as a power factor correction circuit that includes a rectification means and a boosting means that share the first and second switching elements Q1 and Q2.

The power factor correction circuit 1 also includes a current detector 5 that includes a transformer Tr. The transformer Tr includes a primary winding Wlp that constitutes the reactor L1 and a secondary winding Wls that is magnetically coupled to the primary winding Wlp. One end of the secondary winding Wls is connected to the common line, and the other end is connected to a reactor current detection terminal Si of the drive control circuit 2 via a resistor R4.

According to the above-described constitution, the current detector 5 outputs an induced voltage Vwls generated in the secondary winding Wls as will be explained later as a reactor current detection signal. In the present invention, the reactor current detection signal generated based on the induced voltage also includes a case in which the induced voltage itself represents the reactor current detection signal.

The power factor correction circuit 1 includes an input voltage detector 4 that detects input voltages of both ends L and N of the AC power source (Vac) respectively based on the common fine. An L-side output end of the input voltage detector 4 is connected to a first input voltage detection terminal Sv1 of the drive control circuit 2, and an N-side output end of the input voltage detector 4 is connected to a second input voltage detection terminal Sv2 of the drive control circuit 2 via the resistor R1.

In FIG. 1, the input voltage detector 4 is illustrated as a ring provided to both ends L and N of the AC power source Vac. However, this is merely a schematic illustration of the input voltage detector 4 and is not an illustration of the specific circuit constitution. The input voltage detector 4 can have any appropriate constitution as long as it detects the terminal voltages (the input voltages as viewed from the power factor correction circuit 1 side; hereinafter, also referred to simply as the "input voltages") of both ends L and N of the AC power source (Vac) respectively based on the common line.

The operation of the power factor correction circuit 1 will be explained below referring to FIGS. 1 and 2.

In the waveforms shown in FIG. 2, (a) is a voltage waveform between both ends of the AC power source Vac, (b) is a reactor current IL1 flowing to the reactor L1 (the primary winding Wlp), (c) is the induced voltage Vwls generated in the secondary winding Wls, (d) is an input voltage Vsl on the L-side of the AC power source Vac, (e) is an input voltage Vsn on the N-side of the AC power source Vac, and (f) is a zero current detection voltage Vzd to be explained later.

Figure 2:
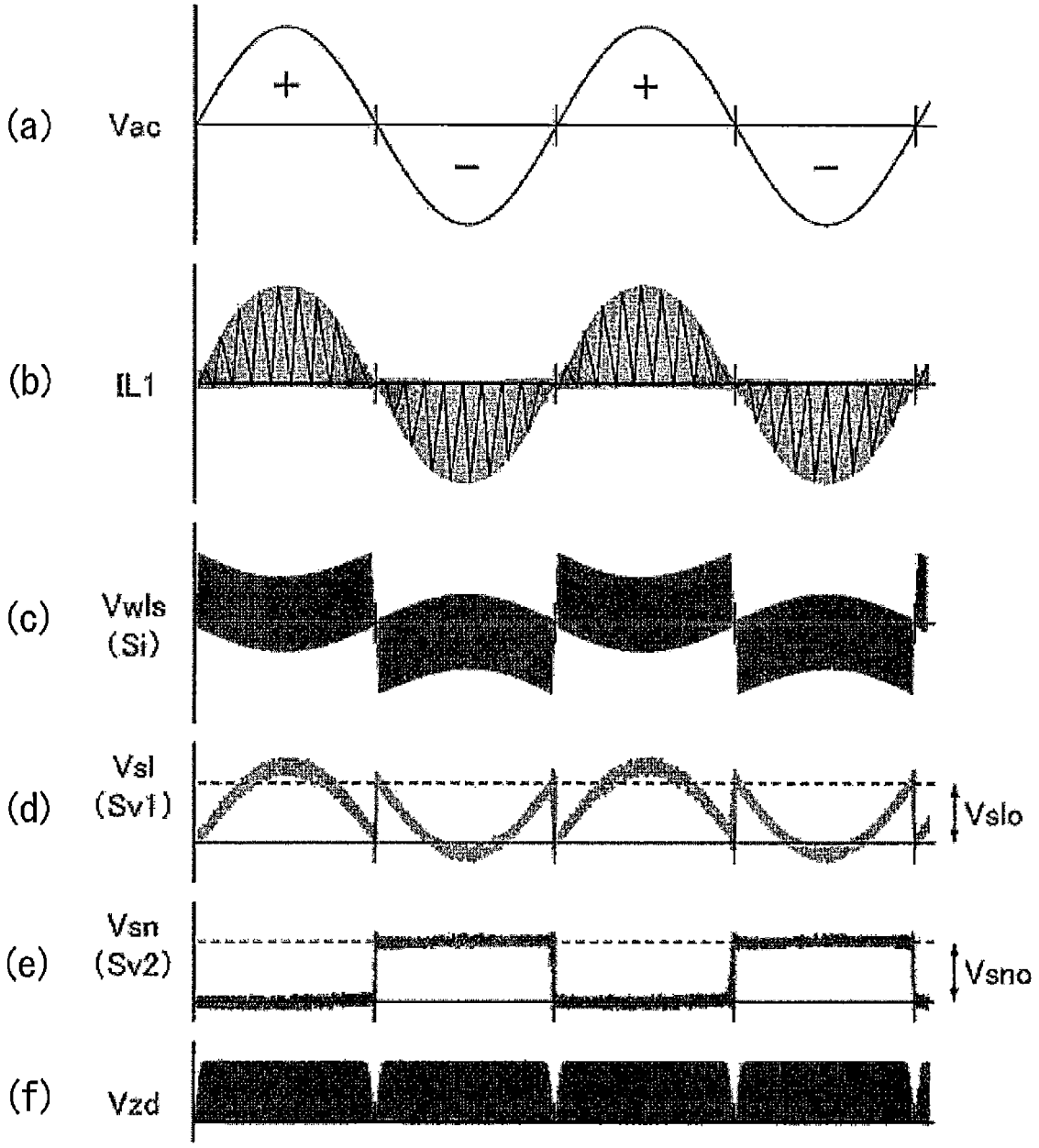
FIG. 2 is a waveform diagram illustrating the operation of the essential parts of the power factor correction circuit shown in FIG. 1.

In the present invention, the half cycle in which the L side among both ends L and N of the AC power source Vac becomes high voltage is referred to as a positive half cycle (shown by the symbol "+" in FIG. 2(*a*)), and the half cycle in which the N side becomes high voltage is referred to as a negative half cycle (shown by the symbol "−" in FIG. 2(*a*)). In the reactor current IL1 in FIG. 2(*b*), the direction flowing from the connecting point of the reactor L1 and the AC power source Vac to the connecting point of the first series circuit D1-Q1 is shown as the positive direction. In the voltages Vwls, Vsl, Vsn, and Vzd in FIGS. 2 (*c*), (*d*), (*e*), and (*f*), the positive and negative of each voltage is shown using the potential of the common line as a reference (in other words, the value of this potential is 0).

Further, the waveforms of Vwls and Vzd shown in FIGS. 2 (*c*) and (*f*) oscillate in accordance with the ON/OFF operation of the first and second switching elements Q1 and Q2 as will be explained later. However, for the sake of explanation, the waveforms in FIGS. 2 (*c*) and (*f*) are shown as regions that are entirely filled in. Therefore, the top and the bottom of the filled region of each waveform respectively represent a maximum envelope and a minimum envelope for one cycle of the ON/OFF operation of the first and second switching elements Q1 and Q2.

In the reactor current IL1 in FIG. 2(*b*), in addition to filled regions similar to those in FIGS. 2 (*c*) and (*f*), an oscillatory waveform of the reactor current IL1 in a critical mode is schematically illustrated.

In the power factor correction circuit 1, the input voltage of the AC power source Vac is detected by the input voltage detector 4 and the reactor current from the AC power source Vac is detected by the current detector 5. Thereby, the operation in the critical mode is realized as follows. The power factor correction circuit 1 is constituted such that the first and second switching elements Q1 and Q2 are synchronously ON/OFF operated in accordance with a common gate drive signal output from the drive signal output terminal Do. As the gate drive signal that drives the first and second switching elements Q1 and Q2, separate drive signals can be used in accordance with the design specifications for the power factor correction circuit 1 such as efficiency improvement or the like.

First, in the positive half cycle of the AC power source Vac, while the first switching element Q1 is turned ON, a current path is formed in which a reactor current flows from the L-side terminal of the AC power source Vac to the reactor L1, between the source and drain of the first switching element Q1, between the source and drain of the second switching element Q2, and finally to the N-side terminal of the AC power source Vac. The reactor current IL1 in the positive direction flowing to the reactor L1 gradually increases, and energy corresponding to the current value is stored in the reactor L1.

Next, when the first switching element Q1 is turned OFF, a current path is formed in which the reactor current flows from the L-side terminal of the AC power source Vac to the reactor L1, through the first rectifier element D1, and then charges the smoothing capacitor C2. The energy stored in the reactor L1 while the first switching element Q1 was ON is transported to the smoothing capacitor C2. During this time, the reactor current HA gradually decreases with the value directly before the first switching element Q1 is turned OFF as a peak value. In this case, a return path for the reactor current to the N-side terminal of the AC power source Vac is provided via the fourth rectifier element D4.

Herein, the secondary winding Wls of the transformer Tr is wound such that the induced voltage Vwls in which the output end side (a resistor R4 side) becomes a negative voltage is generated in the secondary winding Wls while the reactor current IL1 that flows through the primary winding Wlp in the positive direction increases (and while the reactor current IL1 that flows in the negative direction decreases), and the induced voltage Vwls in which the output end side (a resistor R4 side) becomes a positive voltage is generated in the secondary winding Wls while the reactor current IL1 that flows through the primary winding Wlp in the positive direction decreases (and while the reactor current IL1 that flows in the negative direction increases).

Therefore, in the positive half cycle of the AC power source Vac, while the first switching element Q1 is turned ON and the reactor current IL1 in the positive direction is increasing, a negative induced voltage Vwls is generated in the secondary winding Wls, and white the first switching element Q1 is turned OFF and the reactor current IL1 in the positive direction is decreasing from the peak value, a positive induced voltage Vwls is generated in the secondary winding Wls.

The current detector 5 outputs the induced voltage Vwls generated as described above in the secondary winding Wls to the drive control circuit 2 as a reactor current detection signal. For the positive induced voltage Vwls generated while the first switching element Q1 is turned OFF and the reactor current IL1 in the positive direction is decreasing from the peak value, the drive control circuit 2 detects a drop in the waveform in which the induced voltage Vwls drops toward zero because the reactor current IL1 becomes zero, and thereby detects the time point at which the reactor current IL1 (reactor current from the AC power source Vac) becomes zero.

In detail, in the power factor correction circuit 1, the drive control circuit 2 includes a shaping unit (not illustrated) for respectively converting the positive voltage and negative voltage of the induced voltage Vwls that has been input into a fixed High level and Low level (in this case, the potential of the common line) and shaping the induced voltage Vwls into a rectangular waveform (the zero current detection voltage Vzd shown in FIG. 2(*f*)) that oscillates between the High level and the Low level. The drive control circuit 2 also includes a zero current detector (not illustrated) in which a threshold voltage is set to an appropriate level between the High level and the Low level. The zero current detector uses the threshold voltage to detect a drop from the High level in the zero current detection voltage Vzd output from the shaping unit, and thereby determines the time point at which the reactor current IL1 becomes zero.

The drive control circuit 2 is constituted to turn the first switching element Q1 ON immediately after the zero current is detected as described above, and then turn the first switching element Q1 OFF again after a certain period of time has passed. During the positive half cycle, by repeating this kind of ON/OFF operation of the first switching element Q1, the power factor correction circuit 1 is operated in the critical mode and a desired DC voltage is fed to the load circuit 3.

Next, in the negative half cycle of the AC power source Vac, while the second switching element Q2 is turned ON, a current path is formed in which a reactor current flows from the N-side terminal of the AC power source Vac between the source and drain of the second switching element Q2, between the source and drain of the first switching element Q1, through the reactor L1, and finally to the L-side terminal of the AC power source Vac. The reactor current IL1 in the negative direction flowing to the reactor L1 gradually increases, and energy corresponding to the current value is stored in the reactor L1.

When the second switching element Q2 is turned OFF, a current path is formed in which the reactor current flows from the N-side terminal of the AC power source Vac through the second rectifier element D2, and then charges the smoothing capacitor C2. The energy stored in the reactor L1 while the second switching element Q2 was ON is transported to the smoothing capacitor C2. During this time, the reactor current IL1 in the negative direction gradually decreases with the value directly before the second switching element Q2 is turned OFF as a peak value. In this case, a return path for the reactor current to the L-side terminal of the AC power source Vac is provided via the third rectifier element D3.

Therefore, in the negative half cycle of the AC power source Vac, while the second switching element Q2 is turned ON and the reactor current IL1 in the negative direction is increasing, a positive induced voltage Vwls is generated in the secondary winding Wls, and while the second switching element Q2 is turned OFF and the reactor current IL1 in the negative direction is decreasing from the peak value, a negative induced voltage Vwls is generated in the secondary winding Wls.

In other words, the current detector 5 is constituted such that, with respect to the induced voltage Vwls generated in the secondary winding Wls, the polarity in the case that the induced voltage Vwls is generated in accordance with the ON/OFF of the first switching element Q1 during the positive half cycle of the AC power source Vac is opposite from the polarity in the case that the induced voltage Vwls is generated in accordance with the ON/OFF of the second switching element Q2 during the negative half cycle of the AC power source Vac.

The current detector 5 outputs the induced voltage Vwls generated as described above in the secondary winding Wls to the drive control circuit 2 as a reactor current detection signal. For the negative induced voltage Vwls generated while the second switching element Q2 is turned OFF and the reactor current IL1 in the negative direction is decreasing from the peak value, the drive control circuit 2 detects a rise in the waveform in which the induced voltage Vwls rises toward zero because the reactor current IL1 becomes zero, and thereby detects the time point at which the reactor current IL1 (reactor current from the AC power source Vac) becomes zero.

Herein, in the power factor correction circuit 1, the input voltages (input voltage detection signals) Vsl and Vsn from both ends L and N of the AC power source Vac are input from the input voltage detector 4 to the drive control circuit 2, and the drive control circuit 2 includes a discriminating unit that uses the input voltages Vsl and Vsn to discriminate between the positive half cycle and the negative half cycle of the AC power source Vac. Thereby, the drive control circuit 2 detects an appropriate zero current depending on the respective polarity for a reactor current detection signal (in this example, the induced voltage Vwls) that is input into one reactor current detection terminal Si and whose polarity is reversed between the positive half cycle and the negative half cycle.

In detail, the drive control circuit 2 can be constituted to include a reversing unit (not illustrated) that reverses the polarity of a voltage signal input into the reactor current detection terminal Si. If it is determined by the discriminating unit that the AC power source Vac is in the negative half cycle, the polarity of the induced voltage Vwls that has been input is reversed by the reversing unit and then a zero current detection voltage Vzd having the same polarity with the positive half cycle is obtained by the shaping unit (refer to FIG. 2(*f*)). Thereby, the zero current detector of the drive control circuit 2 uses the same threshold voltage as in the case of the positive half cycle to detect a drop from the High level in the zero current detection voltage Vzd, and thereby the time point at which the reactor current IL1 in the negative direction becomes zero can be determined.

The drive control circuit 2 is constituted to turn the second switching element Q2 ON immediately after the zero current is detected, and then turn the second switching element Q2 OFF again after a certain period of time has passed. During the negative half cycle, by repeating this kind of ON/OFF operation of the second switching element Q2, the power factor correction circuit 1 is operated in the critical mode and a desired DC voltage is fed to the load circuit 3 similar to during the positive half cycle.

The discriminating unit of the drive control circuit 2 can also obtain a differential voltage "Vsl-Vsn" from the input voltages (input voltage detection signals) Vsl and Vsn of both ends L and N of the AC power source Vac that have been input, and discriminate between the positive half cycle and the negative half cycle based on the sign (positive or negative) of the differential voltage.

Alternatively, in the power factor correction circuit 1, as shown in FIG. 2(*e*), since the input voltage of the N side of the AC power source Vac has a rectangular waveform which becomes Low level (in this case, the potential of the common line) in the positive half cycle and High level (Vsno as shown in FIG. 2(*e*)) in the negative half cycle, the discriminating unit of the drive control circuit 2 can also use the potential difference of the Low level and High level to discriminate between the positive half cycle and the negative half cycle. In this case, since the input voltage on the L side of the AC power source Vac becomes unnecessary, the input voltage detector 4 can detect only the input voltage Vsn of the N side of the AC power source Vac based on the common line. In the power factor correction circuit 1, as shown in FIG. 2(*d*), in the input voltage Vsl of the L side of the AC power source Vac, an offset voltage Vslo (=Vsno) corresponding to the High level Vsno of the input voltage Vsn of the N side is generated in the negative half cycle.

Herein, the drive control circuit 2 of the power factor correction circuit 1 is preferably constituted by a microcomputer system, and signal processing by the above-mentioned discriminating unit, reversing unit, shaping unit, and zero current detector is carried out by digital calculation. However, the drive control circuit 2 can also carry out part or all of the signal processing by the above-mentioned discriminating unit, reversing unit, shaping unit, and zero current detector by an analog circuit.

In this way, the power factor correction circuit 1 includes the input voltage detector 4 that detects input voltages of both ends L and N or one end N of the AC power source Vac based on one end on the ground side of the smoothing capacitor C2, and the current detector 5 that detects a reactor current from the AC power source Vac. The current detector 5 includes the transformer Tr in which the reactor L1 is a primary side. The first and second switching elements Q1 and Q2 are controlled based on a reactor current detection signal output from a secondary side of the transformer Tr in accordance with a reactor current. Thereby, in the bridgeless power factor correction circuit, it is possible to detect the time point at which the reactor current becomes zero with an inexpensive and simple circuit constitution and to carry out drive control in a critical mode.

In the power factor correction circuit 1, the capacitor C1, one end of which is connected to the connecting point of the AC power source Vac and the reactor L1 and the other end of which is connected to the common line, functions as a noise filter of the AC power source Vac. In particular, the capacitor C1 prevents the L-side terminal of the AC power source Vac from entering a floating state relative to the common line in the negative half cycle of the AC power source Vac, and effectively removes noise from the input voltage of the L-side terminal.

In the power factor correction circuit 1, as described above, the first and second switching elements Q1 and Q2 simultaneously execute their ON/OFF operations in accordance with a common gate drive signal that is output from the drive signal output terminal Do. This constitution of the power factor correction circuit 1 is advantageous from the perspective of simplifying the circuit constitution and the drive control of the switching elements.

However, in the power factor correction circuit according to the present invention, as long as the ON/OFF operation of the first switching element Q1 in the positive half cycle and the ON/OFF operation of the second switching element Q2 in the negative half cycle are carried out as described above, the drive control circuit 2 can independently generate and output the gate drive signal of the first switching element Q1 and the gate drive signal of the second switching element Q2.

In the power factor correction circuit 1, one end of the reactor L1 can be connected to the connecting point of the second rectifier element D2 and the second switching element Q2 and the other end can be connected to the N-side terminal of the AC power source Vac, and the L-side terminal of the AC power source Vac can be connected to the connecting point of the first rectifier element D1 and the first switching element Q1.

Alternatively, the power factor correction circuit according to the present invention can include two reactors: one reactor that is connected to the L-side terminal of the AC power source Vac and one reactor that is connected to the N-side terminal of the AC power source Vac. In this case, the power factor correction circuit includes two current detectors, each having a transformer in which the reactor is a primary side, and the first and second switching elements Q1 and Q2 can be controlled based on reactor current detection signals output from the secondary sides of both transformers in accordance with the reactor currents.

In the power factor correction circuit 1, the primary and secondary windings Wlp and Wls of the transformer Tr can be wound as opposite polarity compared to the polarity shown in FIG. 1. In this case, in the drive control circuit 2, the signal processing by the reversing unit is executed in the positive half cycle of the AC power source Vac.

Next, referring to FIGS. 3 to 8, further embodiments of the present invention will be explained. However, in the following explanations of the embodiments, explanations of portions which are the same upon comparison with any of the embodiments that have already been explained are appropriately omitted and the points of difference thereof will be the focus of the explanations.

Figure 3:
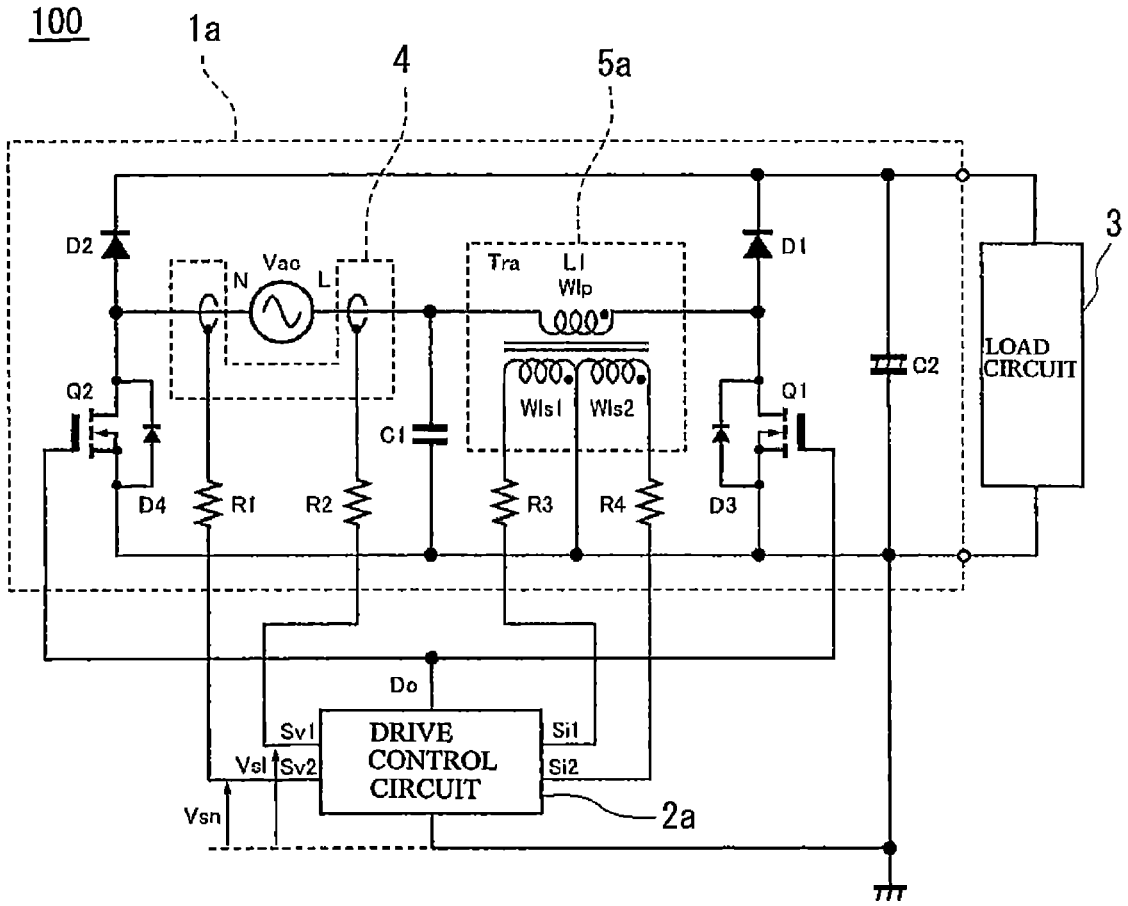
FIG. 3 is a circuit constitution diagram illustrating a power supply apparatus including a power factor correction circuit according to a second embodiment of the present invention.
Figure 4:
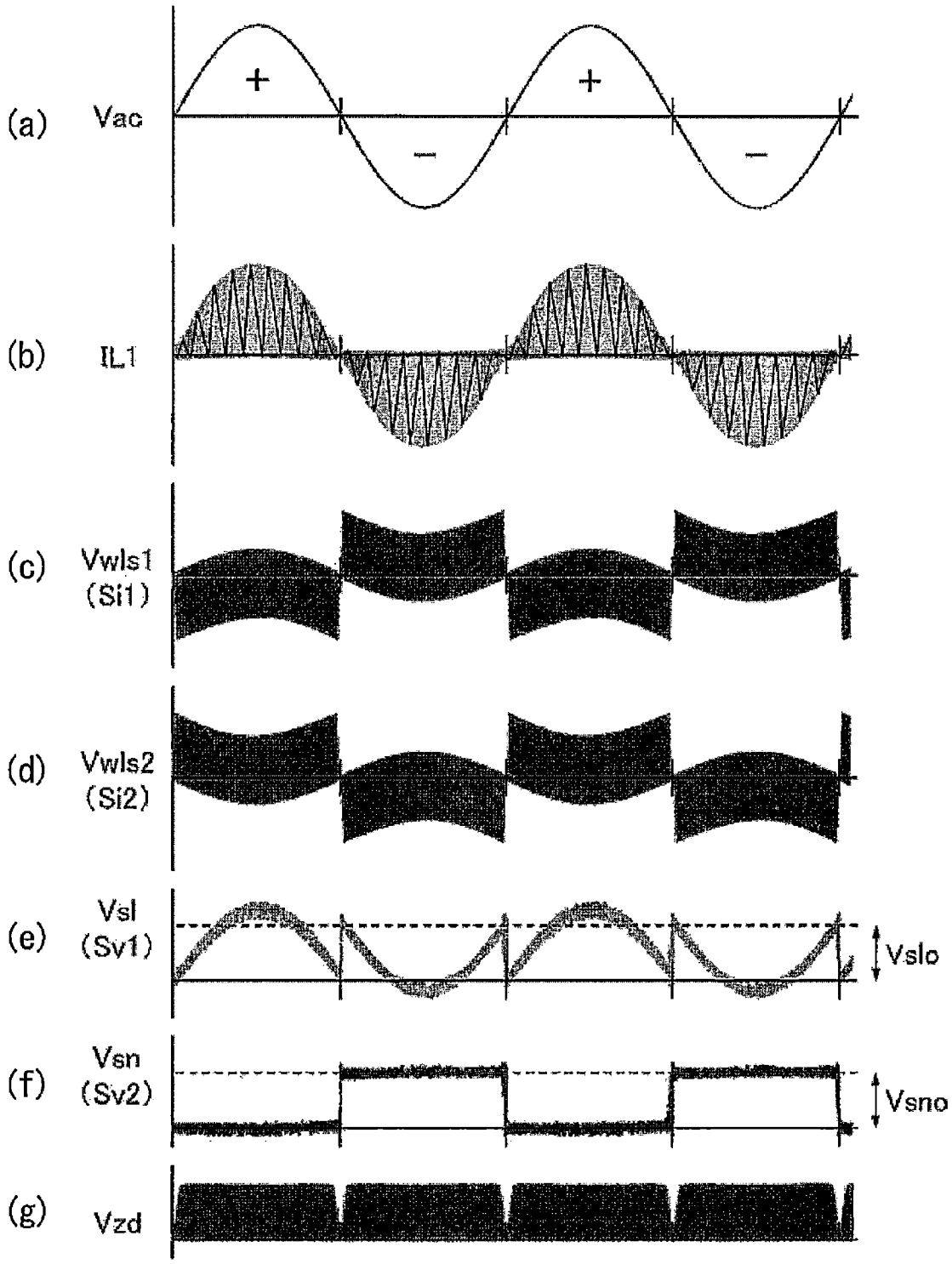
FIG. 4 is a waveform diagram illustrating the operation of the essential parts of the power factor correction circuit shown in FIG. 3.

FIG. 3 is a circuit constitution diagram illustrating a power supply apparatus 100 including a power factor correction circuit 1*a* according to a second embodiment of the present invention. FIG. 4 is a waveform diagram illustrating the operation of the essential parts of the power factor correction circuit 1*a*.

The power factor correction circuit 1*a* differs from the power factor correction circuit 1 shown in FIG. 1 with respect to the following points. The power factor correction circuit 1*a* has a current detector 5*a* including a transformer Tra. The transformer Tra includes a primary winding Wlp that constitutes the reactor L1 and a first and second secondary winding Wls1 and Wls2 that are magnetically coupled to the primary winding Wlp. One end of each of the first and second secondary windings Wls1 and Wls2 is connected to the common line, the other end of the first secondary winding Wls1 is connected to a first reactor current detection terminal Si1 of a drive control circuit 2*a* via a resistor R3, and the other end of the second secondary winding Wls2 is connected to a second reactor current detection terminal Si2 of the drive control circuit 2*a* via a resistor R4.

Therefore, in the current detector 5*a*, the induced voltage generated on the secondary side of the transformer Tra includes a first induced voltage Vwls1 generated in the first secondary winding Wls1 (refer to FIG. 4(*c*)) and a second induced voltage Vwls2 generated in the second secondary winding Wls2 (refer to FIG. 4(*d*)). The current detector 5*a* outputs the first and second induced voltages Vwls1 and Vwls2 to the drive control circuit 2*a* as first and second reactor current detection signals.

The first secondary winding Wls1 of the transformer Tra is wound such that the induced voltage Vwls1 in which the output end side (a resistor R3 side) becomes a positive voltage is generated in the first secondary winding Wls1 while the reactor current IL1 that flows through the primary winding Wlp in the positive direction increases (and while the reactor current IL1 that flows in the negative direction decreases), and the induced voltage Vwls1 in which the output end side (a resistor R3 side) becomes a negative voltage is generated in the first secondary winding Wls1 while the reactor current IL1 that flows through the primary winding Wlp in the positive direction decreases (and while the reactor current IL1 that flows in the negative direction increases).

Further, the second secondary winding Wls2 of the transformer Tra is wound such that the induced voltage Vwls2 in which the output end side (a resistor R4 side) becomes a negative voltage is generated in the second secondary winding Wls2 while the reactor current IL1 that flows through the primary winding Wlp in the positive direction increases (and while the reactor current IL1 that flows in the negative direction decreases), and the induced voltage Vwls2 in which the output end side (a resistor R4 side) becomes a positive voltage is generated in the second secondary winding Wls2 while the reactor current IL1 that flows through the primary winding Wlp in the positive direction decreases (and while the reactor current IL1 that flows in the negative direction increases).

Therefore, in the positive half cycle of the AC power source Vac, while the first switching element Q1 is turned ON and the reactor current IL1 in the positive direction is increasing, a positive induced voltage Vwls1 is generated in the first secondary winding Wls1 and a negative induced voltage Vwls2 is generated in the second secondary winding Wls2, and while the first switching element Q1 is turned OFF and the reactor current IL1 in the positive direction is decreasing from the peak value, a negative induced voltage Vwls1 is generated in the first secondary winding Wls1 and a positive induced voltage Vwls2 is generated in the second secondary winding Wls2.

In the negative half cycle of the AC power source Vac, while the second switching element Q2 is turned ON and the reactor current IL1 in the negative direction is increasing, a negative induced voltage Vwls1 is generated in the first secondary winding Wls1 and a positive induced voltage Vwls2 is generated in the second secondary winding Wls2, and while the second switching element Q2 is turned OFF and the reactor current IL1 in the negative direction is decreasing from the peak value, a positive induced voltage Vwls1 is generated in the first secondary winding Wls1 and a negative induced voltage Vwls2 is generated in the second secondary winding Wls2.

In other words, the current detector 5*a* is constituted such that, with respect to the first and second induced voltages Vwls1 and Vwls2, the polarities in the case that the induced voltages are generated in accordance with the ON/OFF of the first switching element Q1 during the positive half cycle of the AC power source Vac are in a reversed relation to the polarities in the case that the induced voltages are generated in accordance with the ON/OFF of the second switching element Q2 during the negative half cycle of the AC power source Vac, the polarity of the first induced voltage Vwls1 generated in accordance with the ON/OFF of the first switching element Q1 during the positive half cycle of the AC power source Vac is the same with the polarity of the second induced voltage Vwls2 generated in accordance with the ON/OFF of the second switching element Q2 during the negative half cycle of the AC power source Vac, and the polarity of the first induced voltage Vwls1 generated in accordance with the ON/OFF of the second switching element Q2 during the negative half cycle of the AC power source Vac is the same with the polarity of the second induced voltage Vwls2 generated in accordance with the ON/OFF of the first switching element Q1 during the positive half cycle of the AC power source Vac.

In the transformer Tra, the first and second secondary windings Wls1 and Wls2 are constituted using a single winding to which a center tap is provided. The center tap is connected to the common line, and both ends of the winding can be mounted as output ends respectively connected to the resistors R3 and R4.

The power factor correction circuit 1*a* also differs from the power factor correction circuit 1 shown in FIG. 1 in that the drive control circuit 2*a* includes a discriminating unit, a shaping unit, and a zero current detector similar to the drive control circuit 2 of the power factor correction circuit 1, as well as a selecting unit (not illustrated) that selects a reactor current signal used in zero current detection based on the discrimination between the positive and negative half cycles executed by the discriminating unit.

In more detail, if it is determined by the discriminating unit that the AC power source Vac is in the positive half cycle, the drive control circuit 2*a* selects the second reactor current detection signal (the second induced voltage Vwls2) by the selecting unit. If it is determined by the discriminating unit that the AC power source Vac is in the negative half cycle, the drive control circuit 2*a* selects the first reactor current detection signal (the first induced voltage Vwls1) by the selecting unit. The first or second reactor current detection signal selected in the respective half cycle is subjected to signal processing by the shaping unit, and thereby a zero current detection voltage Vzd in which the polarity is uniform through the entire cycle of the AC power source Vac can be obtained.

Thereby, the zero current detector of the drive control circuit 2*a* detects a drop from the High level in the zero current detection voltage Vzd using the common threshold value through the entire cycle of the AC power source Vac while utilizing the two reactor current detection signals that are input into the two reactor current detection terminals Si1 and Si2 and have reversed polarities. Thereby, the time point at which the current values of the reactor currents IL1 in both the positive and negative directions become zero can be determined, and drive control in the critical mode can be executed similar to the power factor correction circuit 1.

The drive control circuit 2*a* is preferably constituted by a microcomputer system similar to the drive control circuit 2, and the signal processing by the discriminating unit, the shaping unit, the selecting unit, and the zero current detector is carried out by digital calculation. However, the drive control circuit 2*a* can also carry out part or all of the signal processing by the above-mentioned discriminating unit, shaping unit, selecting unit, and zero current detector by an analog circuit. Needless to say, the drive control circuit 2*a* is not required to have the function of the reversing unit of the drive control circuit 2.

In the drive control circuit 2*a*, the first reactor current detection signal (the first induced voltage Vwls1), the second reactor current detection signal (the second induced voltage Vwls2), and the input voltage detection signal (the input voltages Vsl and Vsn) are input by a combination of the functions of the discriminating unit, the selecting unit, and the shaping unit. Also, the discriminating unit, the selecting unit, and the shaping unit output a signal (the zero current detection signal Vzd in the positive half cycle) generated based on the second reactor current signal in the positive half cycle of the AC power source Vac and output a signal (the zero current detection signal Vzd in the negative half cycle) generated based on the first reactor current signal in the negative half cycle of the AC power source Vac, and thereby constitute a switching unit in the present embodiment.

In the power factor correction circuit 1*a*, the primary winding Wlp and the first and second secondary windings Wls1 and Wls2 of the transformer Tra can be wound as opposite polarities from those shown in FIG. 3. In this case, in the drive control circuit 2*a*, the selecting unit operates so as to select the first reactor current detection signal (the first induced voltage Vwls1) in the positive half cycle and to select the second reactor current detection signal (the second induced voltage Vwls2) in the negative half cycle.

Figure 5:
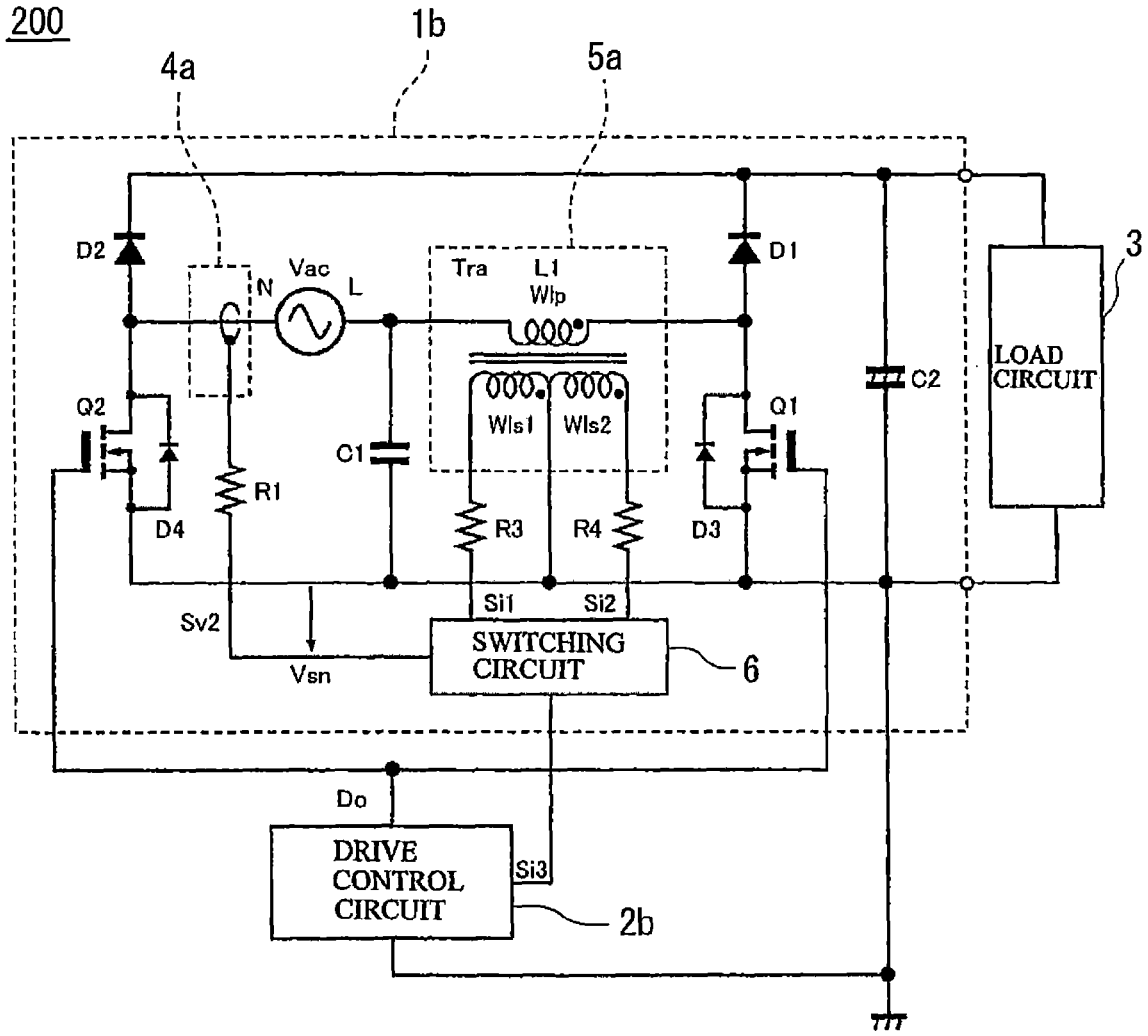
FIG. 5 is a circuit constitution diagram illustrating a power supply apparatus including a power factor correction circuit according to a third embodiment of the present invention.
Figure 6:
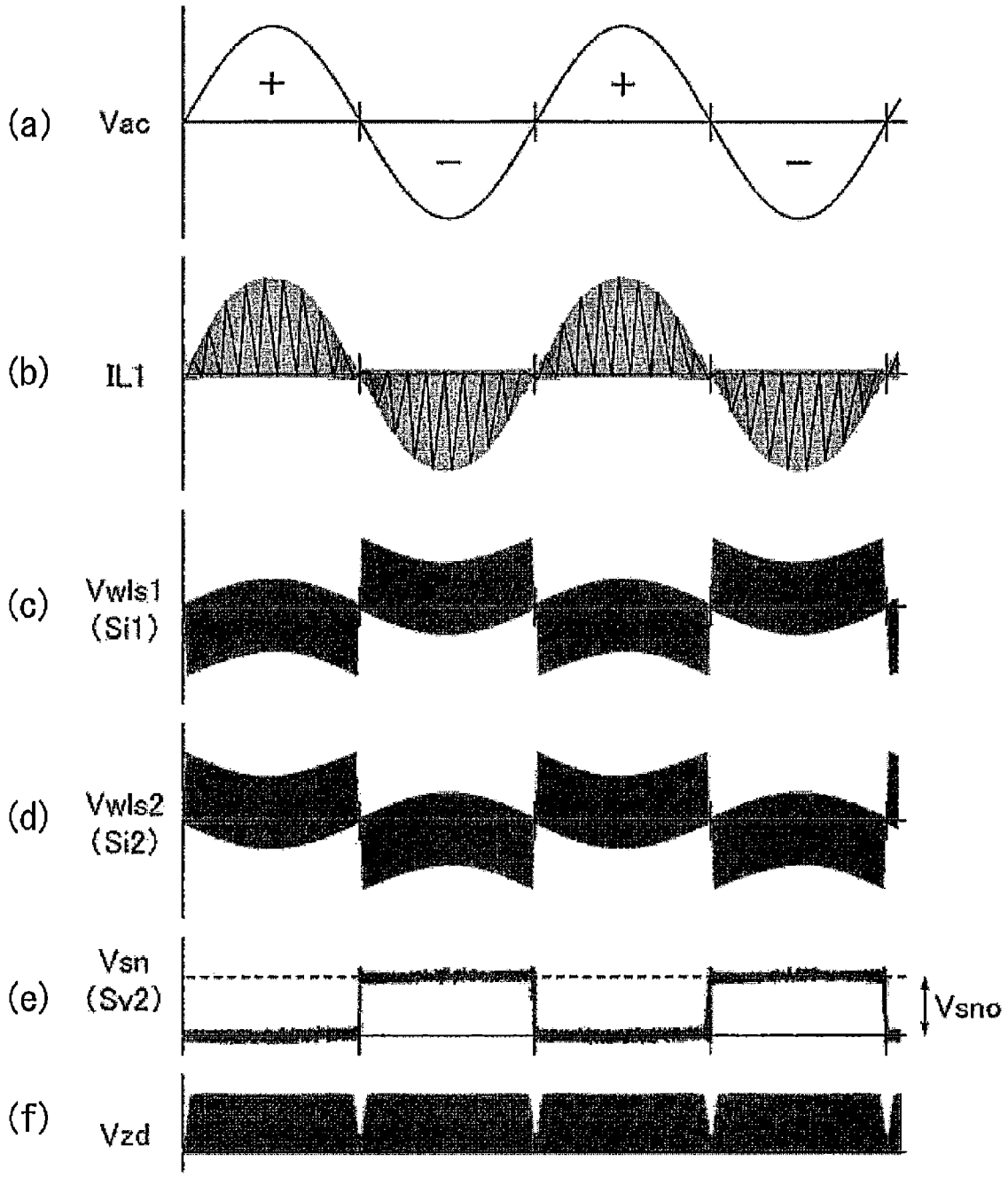
FIG. 6 is a waveform diagram illustrating the operation of the essential parts of the power factor correction circuit shown in FIG. 5.

FIG. 5 is a circuit constitution diagram illustrating a power supply apparatus 200 including a power factor correction circuit 1*b* according to a third embodiment of the present invention. FIG. 6 is a waveform diagram illustrating the operation of the essential parts of the power factor correction circuit 1*b*.

The power factor correction circuit 1*b* differs from the power factor correction circuit 1*a* shown in FIG. 3 in that the above-described switching unit is provided outside of a drive control circuit 2*b* as a switching circuit 6. The power factor correction circuit 1*b* is also an example in which an input voltage detector 4*a* is constituted so as to detect only an input voltage of the N-side terminal of the AC power source Vac.

In the power factor correction circuit 1*b*, the output end of the first secondary winding Wls1 of the transformer Tra is connected to the first reactor current detection terminal Si1 of the switching circuit 6 via the resistor R3, and the output end of the second secondary winding Wls2 is connected to the second reactor current detection terminal Si2 of the switching circuit 6 via the resistor R4. The output end of the input voltage detector 4*a* is connected to an input voltage detection terminal Sv2 of the switching circuit 6 via the resistor R1.

The first reactor current detection signal (the first induced voltage Vwls1), the second reactor current detection signal (the second induced voltage Vwls2), and the input voltage detection signal (the input voltage Vsn of the N-side terminal of the AC power source) are input into the switching circuit 6. The switching circuit 6 executes a function similar to that of the discriminating unit, the selecting unit, and the shaping unit of the drive control circuit 2*a* described above, and thereby outputs the zero current detection signal Vzd (refer to FIG. 6(*f*)) generated based on the second reactor current signal in the positive half cycle of the AC power source Vac and outputs the zero current detection signal Vzd corresponding to the first reactor current signal in the negative half cycle of the AC power source Vac to a zero current detection terminal Si3 of the drive control circuit 2*b*.

By the above-described structure, the power factor correction circuit 1*b* according to the present embodiment carries out drive control in the critical mode similar to the power factor correction circuit 1*a*. Further, in the power factor correction circuit 1*b*, by providing the switching circuit 6 separate from the drive control circuit 2*b*, an inexpensive general-purpose controller IC including at least a function equivalent to that of the zero current detector of the drive control circuit 2*a* can be used as the drive control circuit 2*b*.

The power factor correction circuit 1*b* according to the present embodiment is not limited by the concrete structure of the switching circuit 6. However, an example of a preferable structure and operation will be explained as follows referring to FIG. 7.

Figure 7:
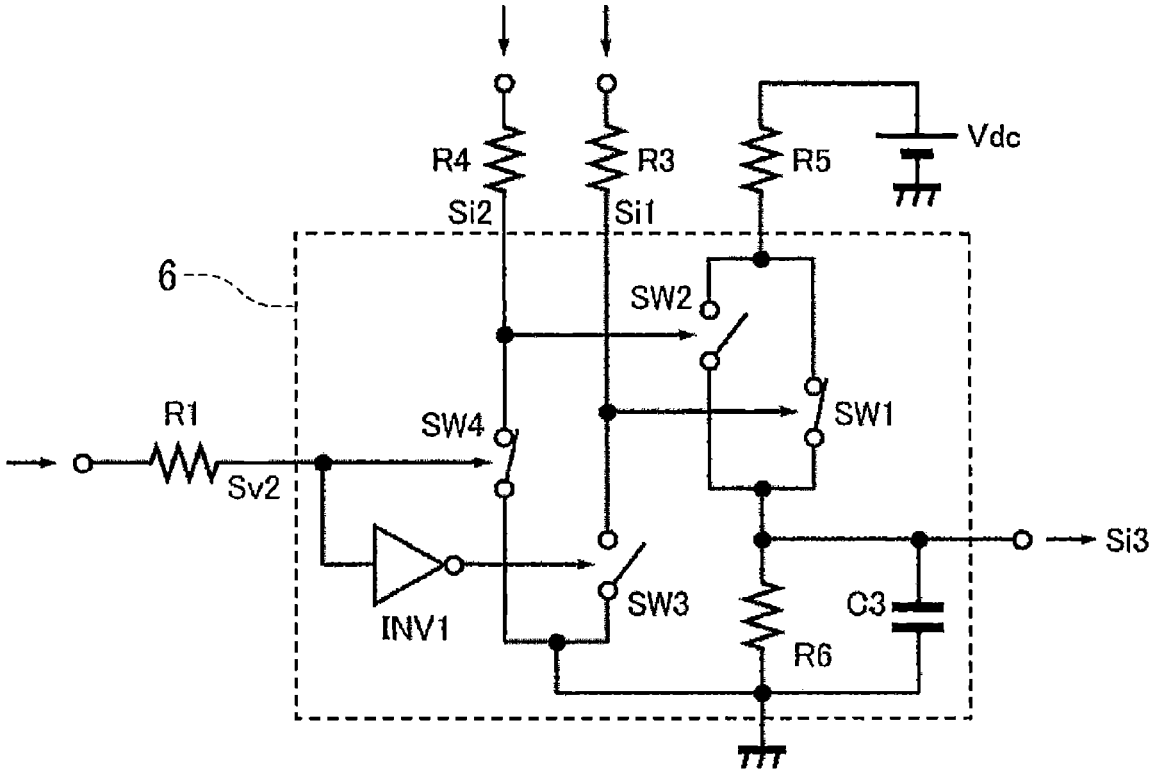
FIG. 7 is a circuit constitution diagram illustrating one example of a switching circuit in the power factor correction circuit shown in FIG. 5.

The switching circuit 6 shown in FIG. 7 includes a third and a fourth switching element SW1 and SW2. One end of each of the third and fourth switching elements SW1 and SW2 is connected to a DC power source Vdc via a resistor R5, and the other end of each is grounded via a resistor R6. One end on the side that is not grounded of the resistor R6 is connected to the output terminal of the switching circuit 6. Further, the switching circuit 6 includes an output capacitor C3, one end of which is connected to the output terminal and the other end of which is grounded. A voltage of the output capacitor C3 is output to the reactor current detection terminal Si3 of the drive control circuit 2*b*. The ground of the switching circuit 6 is the same with the ground of the output of the power factor correction circuit 1*b* (and thus, the common line described above), and the grounding potential is the potential of the common line.

The switching circuit 6 also includes a fifth and a sixth switching element SW3 and SW4, and the first and second input terminals Si1 and Si2 of the switching circuit 6 are respectively grounded via the fifth and sixth switching elements SW3 and SW4. The switching circuit 6 includes an inverter INV1. The opening/closing of the sixth switching element SW4 is controlled by an input voltage detection signal (the input voltage Vsn of the N-side of the AC power source Vac) that is input from the third input terminal Sv2, and the opening/closing of the fifth switching element SW3 is controlled by a signal that logically inverts the input voltage detection signal via the inverter INV1.

The opening/closing of the third and fourth switching elements SW1 and SW2 of the switching circuit 6 is respectively controlled by the first and second reactor current detection signals (the first and second induced voltages Vwls1 and Vwls2) that are input from the first and second input terminals Si1 and Si2.

Herein, the third to sixth switching elements SW1 to SW4 are constituted by, for example, MOS-FETs, and in this case, the signals that control the opening/closing of the switching elements SW1 to SW4 are used as gate drive signals of the switching elements SW1 to SW4.

In the present embodiment, the third to sixth switching elements SW1 to SW4 are constituted by MOS-FETs, and the switching elements SW1 to SW4 are turned ON (the state in which the switch is closed in FIG. 7) when the gate drive signal is at a predetermined High level and are turned OFF (the state in which the switch is opened in FIG. 7) when the gate drive signal is at a predetermined Low level. The first and second current detection signals and the input voltage detection signal input into the switching circuit 6 are capable of outputting the High and Low levels necessary for driving the switching elements SW1 to SW4.

The circuit constitution diagram shown in FIG. 7 is mainly for explaining the operational principle, and it is needless to say that any appropriate circuit elements (for example, a drive circuit for driving the switching elements SW1 to SW4 based on an input signal, or a zener diode for protecting the switching elements SW1 to SW4, etc.) can be added to the circuit constitution shown in FIG. 7 as necessary. This also applies to the circuit constitutions to be explained later referring to FIGS. 8 to 11.

The operation of the switching circuit 6 described above is explained as below.

FIG. 7 illustrates the state of the switching circuit 6 at a point in which the second switching element Q2 is turned OFF and the reactor current IL1 in the negative direction flowing to the reactor L1 is decreasing from the peak value in the negative half cycle of the AC power source Vac. At this time, the positive first induced voltage Vwls1 is generated in the first secondary winding Wls1 of the transformer Tra.

In the negative half cycle, since the input voltage Vsn of the N-side of the AC power source Vac becomes High level (refer to FIG. 6(*e*)), the sixth switching element SW4 enters an ON (closed) state. Thereby, the gate drive signal of the fourth switching element SW2 is fixed at a grounding potential, and the fourth switching element SW2 is fixed in an OFF (opened) state.

Meanwhile, the gate drive signal of the fifth switching element SW3 is logically inverted from the High level of the input voltage Vsn and becomes Low level, and thus the fifth switching element SW3 enters an OFF (opened) state. Thereby, the third switching element SW1 is ON/OFF controlled by the first induced voltage Vws1 input from the first input terminal Si1 which serves as a gate drive signal.

In the state shown in FIG. 7, the positive first induced voltage Vwls1 is generated in the first secondary winding Wls1 of the transformer Tra, and thereby the third switching element SW1 enters an ON (closed) state. At this time, the output capacitor C3 is charged up to the voltage (also indicated by reference numeral Vdc) of the DC power source Vdc, and the voltage Vdc is output from the output terminal of the switching circuit 6.

Next, in the negative half cycle, when the reactor current IL1 in the negative direction flowing to the reactor L1 becomes 0 and consequently the first induced voltage Vwls1 drops below a predetermined threshold value of the gate drive signal, the third switching element SW1 enters an OFF (opened) state, and the charge that was charged to the output capacitor C3 is discharged via the resistor R6. Thereby, a grounding potential is output from the output terminal of the switching circuit 6. Zero current detection is then carried out by the drop in the output potential from the switching circuit 6, and while the second switching element Q2 is turned ON and the negative first induced voltage Vwls1 is generated in the first secondary winding Wls1, the state in which a grounding potential is output from the output terminal is continued. Next, after a certain period of time has passed, the second switching element Q2 is turned ON again and the positive first induced voltage Vwls1 is generated in the first secondary winding Wls1. When it rises above a predetermined threshold value of the gate drive signal, the third switching element SW1 enters an ON (closed) state again, and the operation is subsequently repeated.

In this way, the switching circuit 6 respectively converts the positive voltage and negative voltage of the first induced voltage Vwls1 that has been input to a certain High level (in this case, the DC power source voltage Vdc) and Low level (in this case, the grounding potential) in the negative half cycle of the AC power source Vac, and outputs the first induced voltage Vwls1 to the drive control circuit 2*a* as the zero current detection voltage Vzd (refer to FIG. 6(*f*)) that oscillates between the High level and the Low level.

The operation of the switching circuit 6 in the positive half cycle of the AC power source Vac is similar with the operation in the negative half cycle described above except that the operations of the third switching element SW1 and the fourth switching element SW2 as well as the operations of the fifth switching element SW3 and the sixth switching element SW4 are switched, and the output signal of the switching circuit 6 is generated based on the second induced voltage Vwls2 generated in the second secondary winding Wls2 of the transformer Tra. Thus, an explanation of this operation will be omitted.

Figure 8:
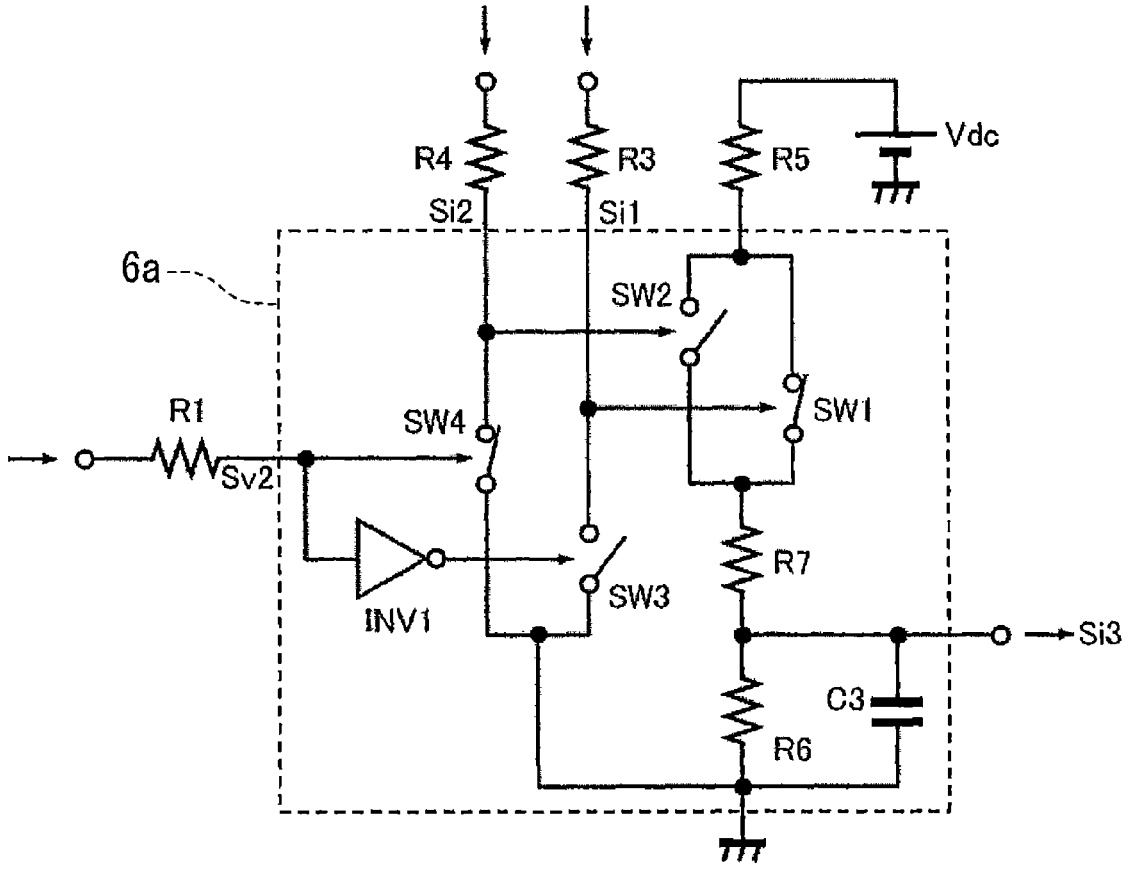
FIG. 8 is a circuit constitution diagram illustrating another example of a switching circuit in the power factor correction circuit shown in FIG. 5.

Herein, the switching circuit of the power factor correction circuit 1*b* can also be constituted like the switching circuit 6*a* shown in FIG. 8. The switching circuit 6*a* is the same with the switching circuit 6 shown in FIG. 7 except that one end of each of the third and fourth switching elements SW1 and SW2 is connected to the resistor R6 via a resistor R7.

The switching circuit 6*a* executes an operation identical to that of the switching circuit 6 explained above, and by adding the resistor R7, noise components that enter the switching circuit 6*a* via the third to sixth switching elements SW1 to SW4 from the first and second reactor current detection signals and the input voltage detection signal as well as switching noise of the third to sixth switching elements SW1 to SW4 that is mixed into the output signal of the switching circuit 6*a* are suppressed so that the quality of the output signal of the switching circuit 6*a* can be improved.

In the power factor correction circuit 1*b*, the input voltage detector 4*a* can be constituted to detect input voltages of both ends L and N of the AC power source Vac, and the switching circuit 6 can discriminate between the positive or negative half cycle of the AC power source Vac using the input voltages of both ends L and N of the AC power source Vac input from the input voltage detector 4*a*.

Preferred embodiments of the present invention have been described above. However, the power factor correction apparatus according to the present invention is not limited to the above-described embodiments.

In the above-described embodiments, the current detector 5 of the power factor correction circuit 1 outputs the induced voltage Vwls itself as the reactor current detection signal. However, in the power factor correction circuit according to the present invention, the reactor current detection signal can be any appropriate signal as long as it is a signal that is generated based on the induced voltage Vwls and the first and second switching elements Q1 and Q2 can be controlled based on the signal and a desired DC voltage can be supplied to the load circuit 3. This also applies to the first and second reactor current detection signals in the current detector 5*a* of the power factor correction circuits 1*a* and 1*b*.

In the power factor correction circuit 1*b*, the switching circuit 6 outputs the zero current detection voltage Vzd that is generated based on the first or second reactor current detection signal (the first and second induced voltages Vwls1 and Vwls2) that is input. However, in the power factor correction circuit according to the present invention, the output signal of the switching circuit 6 can be any appropriate signal as long as it is a signal that is generated based on the first or second reactor current detection signal and the first and second switching elements Q1 and Q2 can be controlled based on the signal and a desired DC voltage can be supplied to the load circuit 3. In particular, the present invention includes a case in which the switching circuit 6 outputs the first or second reactor current detection signal itself selected in accordance with the positive and negative half cycles of the AC power source Vac as the output signal.

Figure 10:
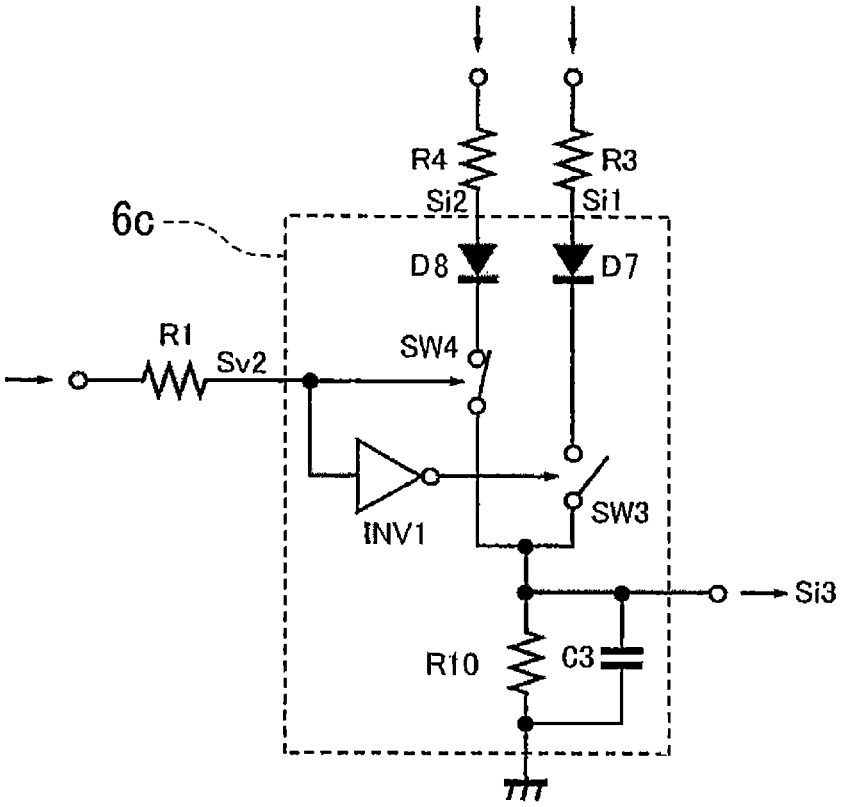
FIG. 10 is a circuit constitution diagram illustrating another example of a switching circuit in the power factor correction circuit shown in FIG. 5.
Figure 11:
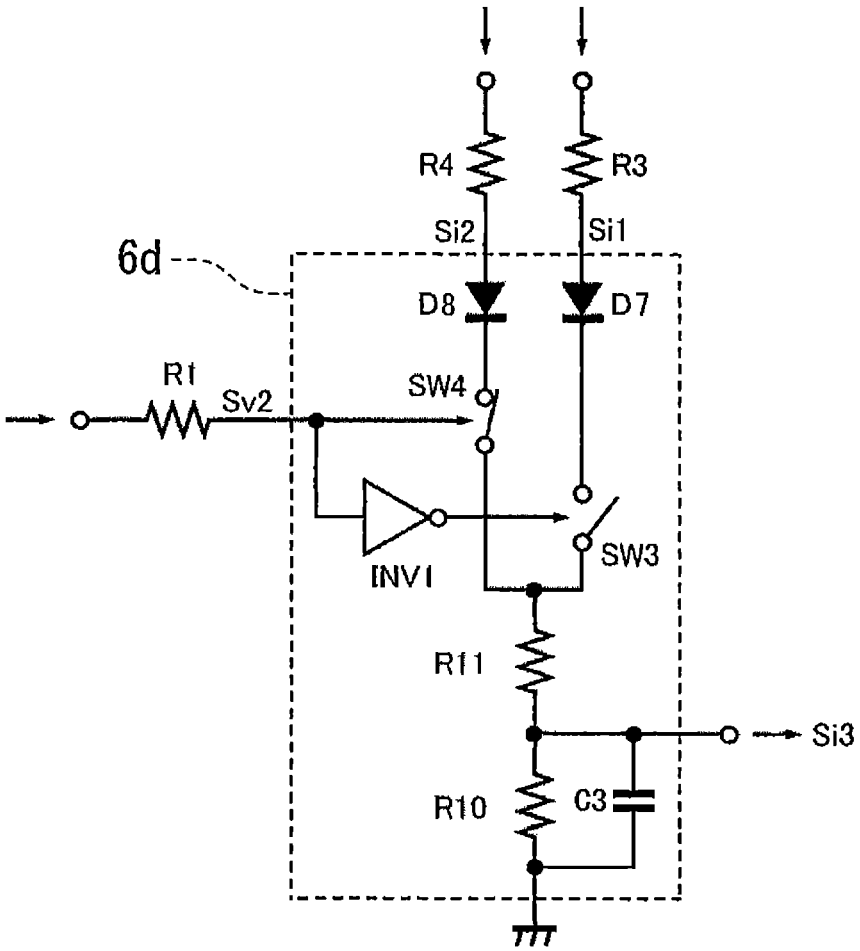
FIG. 11 is a circuit constitution diagram illustrating another example of a switching circuit in the power factor correction circuit shown in FIG. 5.

Various circuit constitutions can be utilized for the switching circuit of the power factor correction circuit 1*b* in addition to the switching circuits 6 and 6*a* shown in FIGS. 7 and 8. For example, the DC power source Vdc is used in the output stage of the switching circuits 6 and 6*a* shown in FIGS. 7 and 8, but FIGS. 9 to 11 illustrate examples of the switching circuit in which the DC power source Vdc is not used.

Figure 9:
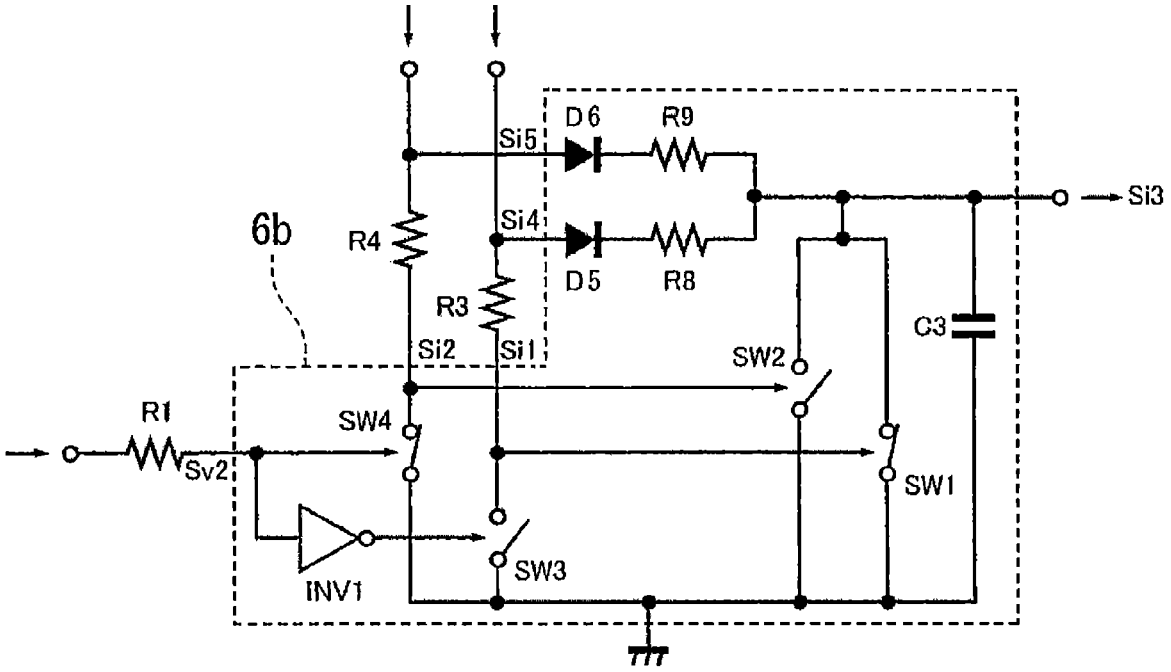
FIG. 9 is a circuit constitution diagram illustrating another example of a switching circuit in the power factor correction circuit shown in FIG. 5.

The switching circuit 6*b* shown in FIG. 9 also includes fourth and fifth input terminals Si4 and Si5 into which the first and second reactor current detection signals are respectively directly input in addition to the first and second input terminals Si1 and Si2 into which the first and second reactor current detection signals are respectively input via the resistors R3 and R4. The fourth input terminal Si4 is connected to the output terminal of the switching circuit 6*b* via a rectifier element D5 and a resistor R8, and the fifth input terminal Si5 is connected to the output terminal of the switching circuit 6*b* via a rectifier element D6 and a resistor R9. The output terminal of the switching circuit 6*b* is grounded via a parallel circuit of the third switching element SW1 and the fourth switching element SW2. Further, the switching circuit 6*b* includes an output capacitor C3, one end of which is connected to the output terminal and the other end of which is grounded.

In the switching circuit 6*b*, in the negative half cycle of the AC power source Vac, when the positive first induced voltage Vwls1 generated in the first secondary winding Wls1 of the transformer Tra rises above a predetermined threshold value of the gate drive signal and the third switching element SW1 enters an ON (closed) state, the output terminal is grounded and a signal of a grounding potential (Low level) is output from the switching circuit 6*b*. Further, when the positive first induced voltage Vwls1 generated in the first secondary winding Wls1 of the transformer Tra drops below a predetermined threshold value of the gate drive signal and the third switching element SW1 enters an OFF (opened) state, the output capacitor C3 is charged via the rectifier element D6 and the resistor R9 by the positive second induced voltage Vwls2 generated in the second secondary winding Wls2 of the transformer Tra, and the positive second induced voltage Vwls2 (High level) at this time is output from the switching circuit 6*b*.

In the switching circuit 6*b*, as described above, in the negative half cycle of the power source Vac, an output signal is generated based on the first reactor current detection signal (the first induced voltage Vwls1). The operation of the switching circuit 6*b* in the positive half cycle of the AC power source Vac is similar with the operation in the negative half cycle described above except that the operations of the third switching element SW1 and the fourth switching element SW2 as well as the operations of the fifth switching element SW3 and the sixth switching element SW4 are switched, and the output signal of the switching circuit 6*b* is generated based on the second induced voltage Vwls2 generated in the second secondary winding Wls2 of the transformer Tra. Thus, an explanation of this operation will be omitted.

In the switching circuit 6*b*, in the case that the third and fourth switching elements SW1 and SW2 have parasitic diodes, the rectifier elements D5 and D6 are used to avoid the influence of the parasitic diodes. If it is not necessary to consider the influence of the parasitic diodes, the switching circuit 6*b* does not have to include the rectifier elements D5 and D6.

The switching circuit 6*c* shown in FIG. 10 executes its function by a simple circuit constitution that does not include the third and fourth switching elements SW1 and SW2. The switching circuit 6*c* is constituted such that the first input terminal Si1 is grounded via a rectifier element D7, the fifth switching element SW3, and a resistor R10, and the second input terminal Si2 is grounded via a rectifier element D8, the sixth switching element SW4, and the resistor R10. The connecting point between the resistor R10 and the fifth and sixth switching elements SW3 and SW4 is connected to the output terminal of the switching circuit 6*c*. Further, the switching circuit 6*c* includes the output capacitor C3, one end of which is connected to the output terminal and the other end of which is grounded. The voltage of the output capacitor C3 is output to the reactor current detection terminal Si3 of the drive control circuit 2*b*. The ground of the switching circuit 6*c* is the same with the ground of the output of the power factor correction circuit 1*b* (and thus, the common line described above), and the grounding potential is the potential of the common line.

In the switching circuit 6*c*, in the negative half cycle of the AC power source Vac, when the sixth switching element SW4 enters an ON (closed) state and the fifth switching element SW3 enters an OFF (opened) state, a potential (High level) in which the positive voltage is voltage divided by the resistor R4 and the resistor R10 is output from the output terminal if the second induced voltage Vwls2 is a positive voltage, and a grounding potential (Low level) is output from the output terminal if the second induced voltage Vwls2 is a negative voltage, based on the second reactor current detection signal (the second induced voltage Vwls2) input from the second input terminal Si2.

In the switching circuit 6*c*, as described above, in the negative half cycle of the AC power source Vac, an output signal is generated based on the second reactor current detection signal (the second induced voltage Vwls2). The operation of the switching circuit 6*c* in the positive half cycle of the AC power source Vac is similar with the operation in the negative half cycle described above except that the operations of the fifth switching element SW3 and the sixth switching element SW4 are switched, and the output signal of the switching circuit 6*c* is generated based on the first induced voltage Vwls1 generated in the first secondary winding Wls1 of the transformer Tra. Thus, an explanation of this operation will be omitted.

In contrast to the switching circuits 6, 6*a*, and 6*b*, in the switching circuit 6*c* as described above, the second reactor current detection signal is selected in the negative half cycle of the AC power source Vac and the first reactor current detection signal is selected in the positive half cycle of the AC power source Vac. Thus, the illustrated circuit constitution is an example of a circuit constitution in which the primary winding Wlp and the first and second secondary windings Wls1 and Wls2 of the transformer Tra of the power factor correction circuit 1*b* are wound as opposite polarities from those shown in FIG. 5. Of course, the switching circuit 6*c* can be easily utilized in the transformer Tra shown in FIG. 5 by constituting it such that the second and first reactor current detection signals are respectively input into the first and second input terminals Si1 and Si2.

The switching circuit of the power factor correction circuit 1*b* can also be constituted like the switching circuit 6*d* shown in FIG. 11. The switching circuit 6*d* is the same with the switching circuit 6*c* shown in FIG. 10 except that one end of each of the fifth and sixth switching elements SW3 and SW4 is connected to the resistor R10 via a resistor R11.

The switching circuit 6*d* executes an operation identical to that of the switching circuit 6*c* explained above, and by adding the resistor R11, noise components that enter the switching circuit 6*d* via the fifth and sixth switching elements SW3 and SW4 from the first and second reactor current detection signals and the input voltage detection signal as well as switching noise of the fifth and sixth switching elements SW3 and SW4 that is mixed into the output signal of the switching circuit 6*d* are suppressed so that the quality of the output signal of the switching circuit 6*d* can be improved.

In the switching circuits 6*c* and 6*d*, in the case that the fifth and sixth switching elements SW3 and SW4 have parasitic diodes, the rectifier elements D7 and D8 are used to avoid the influence of the parasite diodes. If it is not necessary to consider the influence of the parasitic diodes, the switching circuits 6*c* and 6*d* do not have to include the rectifier elements D7 and D8.

Further, with regard to the signal processing in the drive control circuit 2 of the power factor correction circuit 1, the present invention is not dependent on the order in which the processing in the reversing unit and the shaping unit is executed, and the polarity can be reversed after the reactor current detection signal is shaped to a desired waveform as necessary.

The power factor correction circuit 1 can include a reversing circuit that has at least a function equivalent to the discriminating unit and the reversing unit of the drive control circuit 2 on the outside of the drive control circuit 2. The circuit included on the outside of the drive control circuit 2 can be a circuit that includes both the reversing circuit and the switching circuits 6 and 6*a* to 6*d* described above and can be used upon selecting one of the circuits in accordance with the constitution of the power factor correction circuit.

The drive control circuit 2 can execute the zero current detection by using two threshold voltages that are adapted respectively to the polarities of the reactor current detection signals (or the signals after waveform shaping) of the positive and negative half cycles and switching between them in accordance with the positive and negative half cycles of the AC power source Vac, instead of making the polarities of the reactor current detection signals (or the signals after waveform shaping) uniform through the entire cycle of the AC power source Vac.

With regard to the signal processing in the drive control circuit 2*a* of the power factor correction circuit 1*a*, the present invention is not dependent on the order in which the processing in the selecting unit and the shaping unit is executed, and either one of the first or second reactor current detection signals can be selected after shaping them into a desired waveform as necessary.

The waveform shaped by the shaping unit of the drive control circuits 2 and 2*a* of the power factor correction circuit according to the present invention does not necessarily have to be identical to the waveform of the zero current detection voltage Vzd described above as long as zero current detection can be executed. Alternatively, zero current detection can be executed using the reactor current detection signal (or the signal whose polarity is reversed) as is without including a shaping unit.

What is claimed is:

1. A power factor correction circuit comprising:

a first series circuit that consists of a first rectifier element and a first switching element, a second series circuit that consists of a second rectifier element and a second switching element and is connected in parallel to the first series circuit, a smoothing capacitor that is connected in parallel to the first and second series circuits and a load circuit, and a reactor, one end of which is connected to a connecting point between the first rectifier element and the first switching element or a connecting point between the second rectifier element and the second switching element, and the other end of which is connected to one end of an AC power source, wherein the power factor correction circuit further comprises an input voltage detector that detects an input voltage of at least one end of the AC power source based on one end on a ground side of the smoothing capacitor, a current detector that detects a reactor current from the AC power source, the current detector having a transformer in which the reactor is a primary side, and a discriminating unit that discriminates between a positive half cycle and a negative half cycle of the AC power source, and the first and second switching elements are controlled based at least partially on a reactor current detection signal that is output in accordance with the reactor current from a secondary side of the transformer and on a time point at which the reactor current becomes zero as determined by the discriminating unit to supply a desired DC voltage to the load circuit.

2. The power factor correction circuit according to claim 1, wherein the reactor current detection signal is generated based on one or more induced voltages generated on a secondary side of the transformer, and a polarity of the induced voltage generated during a positive half cycle of the AC power source and a polarity of the induced voltage generated during a negative half cycle of the AC power source are in a reversed polarity.

3. The power factor correction circuit according to claim 2, wherein the discriminating unit discriminates the positive half cycle and the negative half cycle of the AC power source based on an input voltage detection signal output from the input voltage detector.

4. The power factor correction circuit according to claim 2, wherein the induced voltage generated on a secondary side of the transformer includes a first and a second induced voltage, the reactor current detection signal includes a first and a second reactor current detection signal generated respectively based on the first and second induced voltages, a polarity of the first induced voltage generated during the positive half cycle of the AC power source and a polarity of the second induced voltage generated during the negative half cycle of the AC power source are correspondent to each other, and a polarity of the first induced voltage generated during the negative half cycle of the AC power source and a polarity of the second induced voltage generated during the positive half cycle of the AC power source are correspondent to each other.

5. The power factor correction circuit according to claim 4, further comprising a switching unit in which the first reactor current detection signal, the second reactor current detection signal, and the input voltage detection signal are input, and a signal generated based on either one of the first reactor current detection signal or the second reactor current detection signal is output according to the positive half cycle and the negative half cycle of the AC power source.

6. The power factor correction circuit according to claim 1, further comprising a capacitor, one end of which is connected to a connecting point between the AC power source and the reactor and the other end of which is connected to one end on a ground side of the smoothing capacitor.

* * * * *